US005365897A

United States Patent [19]

Speil et al.

[11] Patent Number: 5,365,897

[45] Date of Patent: Nov. 22, 1994

[54] MECHANICAL VALVE TAPPET

[75] Inventors: Walter Speil, Ingolstadt; Dieter Schmidt, Nuremberg; Michael Zipprath, Weisendorf, all of Germany

[73] Assignee: Ina Walzlager Schaeffler KG, Germany

[21] Appl. No.: 159,842

[22] Filed: Dec. 1, 1993

[30] Foreign Application Priority Data

Dec. 10, 1992 [DE] Germany ..... 4241669

[51] Int. Cl.[5] ..... F01L 1/14

[52] U.S. Cl. ..... 123/90.52; 123/90.55; 123/90.48

[58] Field of Search ..... 123/90.48, 90.49, 90.52, 123/90.55, 90.58

[56] References Cited

U.S. PATENT DOCUMENTS

| | | | |
|---|---|---|---|
| 4,373,477 | 2/1983 | Buente et al. | 123/90.55 |
| 4,624,225 | 11/1986 | Kowal | 123/90.55 |
| 4,648,360 | 3/1987 | Schaeffler | 123/90.55 |
| 4,694,790 | 9/1987 | Kowal | 123/90.55 |
| 4,709,668 | 12/1987 | Klug et al. | 123/90.55 |
| 4,745,889 | 5/1988 | Speil | 123/90.55 |
| 4,951,619 | 8/1990 | Schaeffler | 123/90.55 |
| 5,029,560 | 7/1991 | Watanabe | 124/90.55 |
| 5,159,907 | 11/1992 | Budde | 123/90.55 |

FOREIGN PATENT DOCUMENTS

| | | | |
|---|---|---|---|
| 502241 | 9/1992 | European Pat. Off. | 123/90.55 |

*Primary Examiner*—E. Rollins Cross
*Assistant Examiner*—Weilun Lo
*Attorney, Agent, or Firm*—Bierman and Muserlian

[57] ABSTRACT

The novel mechanical valve tappet of the invention arranged in a guide bore of a cylinder head of an internal combustion engine is comprised of a cup-shaped housing with a hollow cylindrical wall (1) closed at one end by a bottom (2) which is contacted exteriorly by a control cam while a first flat end face of an adjusting element (7) bears against an inner surface of the bottom (2), a second flat end face of the adjusting element (7) which is parallel to the said first flat end face is in contact with an end of a valve stem of an engine valve, and the adjusting element (7) has a cylindrical peripheral surface and is retained by force engagement in a bore (6) of a hub (3) fixed to the said inner surface of the bottom (2), characterized in that an element (9, 11, 15, 16, 20, 21, 22, 26) which is resiliently biased with respect to the adjusting element (7) and the hub (3) is arranged between the hub (3) and the adjusting element (7).

9 Claims, 7 Drawing Sheets

MECHANICAL VALVE TAPPET

STATE OF THE ART

Figure 1:
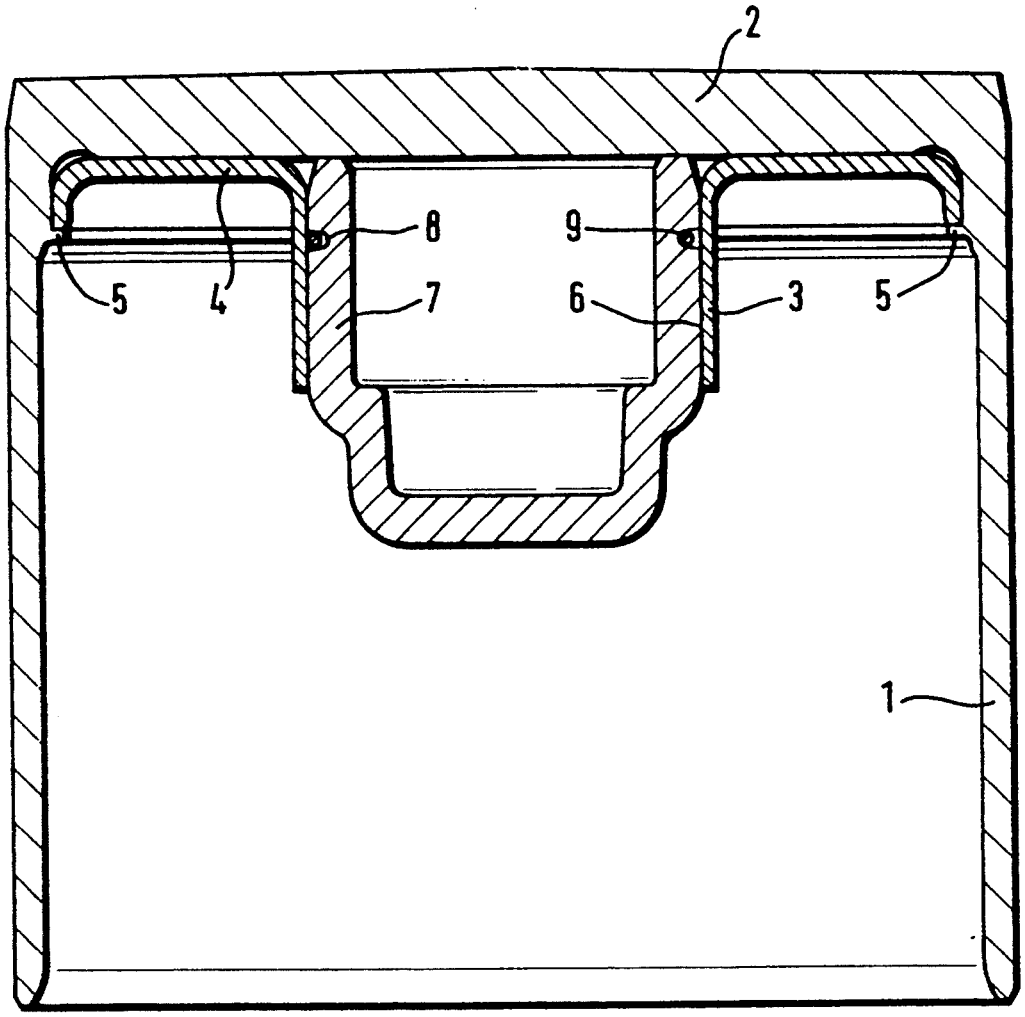

Mechanical valve tappets arranged in a guide bore of a cylinder head of an internal combustion engine comprising a cup-shaped housing with a hollow cylindrical wall closed at one end by a bottom which is contacted exteriorly by a control cam while a first flat end face of an adjusting element bears against an inner surface of the bottom, a second flat end face of the adjusting element which is parallel to the said first flat end face is in contact with an end of a valve stem of an engine valve, and the adjusting element has a cylindrical peripheral surface and is retained by force engagement in a bore of a hub fixed to the inner surface of the bottom is known from EP-A 516,962. Therein, the adjusting element is made as a solid component and is retained by interlocking or force engagement in the hub. This retention by interlocking or force engagement is achieved essentially by the fact that the hub comprises radially inwardly oriented projections which engage elastically into an appropriate groove of the adjusting element. To ensure that the adjusting element reliably remains in the cup-shaped housing during mounting and dismounting operations, the hub has to be necessarily made as a hardened resilient sheet metal part. Otherwise, there would be a danger of the adjusting element falling into the oil sump of the internal combustion engine through oil bores. Thus, a hub of a mechanical valve tappet made in accordance with this patent application is complicated to manufacture because of having to be provided with appropriate spring means and also because of requiring hardening.

OBJECTS OF THE INVENTION

It is an object of the invention to avoid these disadvantages and to provide a retention of the adjusting element within the cup-shaped housing which is favorable for large series.

This and other objects and advantages of the invention will become obvious from the following detailed description.

THE INVENTION

The novel mechanical valve tappet of the invention arranged in a guide bore of a cylinder head of an internal combustion engine is comprised of a cup-shaped housing with a hollow cylindrical wall (1) closed at one end by a bottom (2) which is contacted exteriorly by a control cam while a first flat end face of an adjusting element (7) bears against an inner surface of the bottom (2), a second flat end face of the adjusting element (7) which is parallel to the said first flat end face is in contact with an end of a valve stem of an engine valve, and the adjusting element (7) has a cylindrical peripheral surface and is retained by force engagement in a bore (6) of a hub (3) fixed to the said inner surface of the bottom (2), characterized in that an element (9, 11, 15, 16, 20, 21, 22, 26) which is resiliently biased with respect to the adjusting element (7) and the hub (3) is arranged between the hub (3) and the adjusting element (7).

Because an element which is resiliently biased with respect to the adjusting element and the hub is arranged between the hub and the adjusting element, the adjusting element is reliably retained by force engagement in a simple-to-manufacture hub and, additionally, only relatively rough manufacturing tolerances have to be respected with regard to the hub configuration and the radial dimension of the adjusting element. If manufacturing tolerances are exceeded in the case of an adjusting element pressed directly into the hub, the problem of high stresses in the hub can arise which would eventually lead to its destruction.

The resilient element can be made of an elastomeric material and be arranged in a radial annular groove of the adjusting element and/or the hub. The cross-section of this element made of an elastomeric material is such as to obtain a biasing with respect to both the hub and the adjusting element. Further, the resilient element can be made in the form of a metallic spring washer and be arranged in a radial annular groove of the hub and/or the adjusting element. This metallic spring washer has the advantage that its spring forces do not change at the relatively high temperature occurring in the valve drive.

In a further development of the invention, the resilient element can be made as a metallic spring washer comprising chordlike portions which engage through slots in the hub. Thus, in this case, the spring washer is arranged on the periphery of the hub and only the chordlike portions of the spring washer which engage through the slots bear against the inner adjusting element. Additionally, it is also possible that a metallic ring arranged within the bore of the hub comprises such chordlike portions which bear resiliently against the adjusting element.

Further, the resilient element can be made as a ring comprising resilient fingers projecting in the axial direction which are biased radially inwards and engage through openings in the hub. For example, three such fingers can be provided on the periphery to bear like resilient tabs against the adjusting element.

Further, a resilient element surrounds the hub and biases the hub towards the outer peripheral surface of the adjusting element. In this case, the hub is comprised only of segments which are likewise deformable and are urged against the adjusting element by the resilient element. To this effect, the resilient element can engage behind a collar of each of the segments of the hub. In a further embodiment, a resilient element surrounds a part of the periphery of the hub, and radially inwards angled ends of the resilient element engage in the manner of a shackle through openings in the hub and bear against the peripheral surface of the adjusting element.

Finally, in a further embodiment, there is provided in the region of the bore, a free space in which a resilient element is biased radially and axially towards the bottom at least one contact surface, while the inner periphery of the resilient element bears against projections or against an annular groove of the adjusting element. The resilient element, made preferably as a crinkled spring, is thus supported in the annular groove or on projections and on the contact surface of the hub so that the adjusting element is snapped into this free space with one end face in permanent contact with the bottom. As a result, the adjusting element is fixed in an exactly defined position in the valve tappet so that rattling noises can be avoided.

To realize this embodiment, an end of the hub facing the bottom merges into a truncated portion which continues into a disc-shaped element extending parallel to the bottom, while the resilient element bears against the truncated portion. An appropriate hub which forms the free space by means of a truncated portion can be made with simple means as a chiplessly manufacturable part.

REFERRING TO THE DRAWINGS

FIGS. 1 to 7 are longitudinal cross-sections of mechanical cup tappets showing different embodiments of the invention for fixing the adjusting element.

FIGS. 1*a* to 7*a* each show a partial cross-section of a hub and/or an adjusting element of the respective associated figure.

FIGS. 1 to 7 illustrate a mechanical cup tappet comprising a hollow cylindrical wall 1 and a bottom 2. In the installed state of the mechanical valve tappet, a control cam, not shown, of a camshaft of an internal combustion engine contacts bottom 2. On an inner surface of the bottom 2, there is fixed a hub 3 comprising for this purpose, a radially outwardly extending disc-shaped element 4 which is fixed by a swaging 5 on an inner surface of the hollow cylindrical wall 1 and thus bears by a parallel face against the inner surface of the bottom.

An adjusting element 7, made for reasons of weight as a hollow piston, is arranged in a bore 6 of the hub 3. To adjust the valve clearance of the internal combustion engine, this adjusting element 7, which is on stock in different axial dimensions, can be replaced by an appropriate one. However, during mounting and dismounting operations, the adjusting element must be firmly secured in the cup-shaped housing of the valve tappet. One front end of the adjusting element 7 normally bears against the end of a valve stem of an engine valve.

Figure 1A:
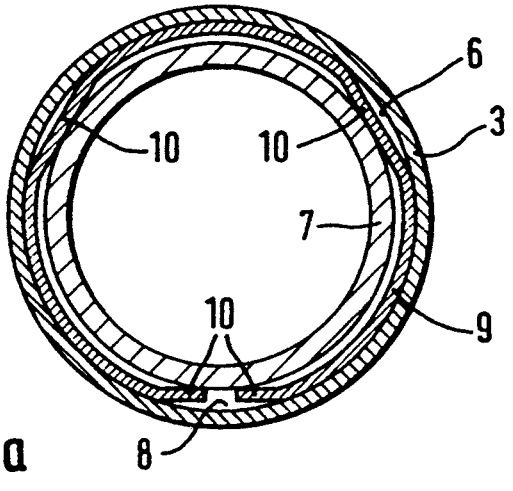

According to FIG. 1, and as can also be seen from the cross-section in FIG. 1*a*, the outer peripheral surface of the adjusting element 7 comprises an annular groove 8 in which a resiliently biased element in the form of a metallic spring washer 9 is arranged which spring washer 9 has a partly polygonal shape resulting from the chordlike portions 10. The ring-shaped portions of the metallic spring washer bear against the bore 6 of the hub 3 while the chordlike portions 10 are situated in the annular groove 8. In this way, the adjusting element 7 and the hub 3 are in a state of mutual resilient tension.

Figure 2:
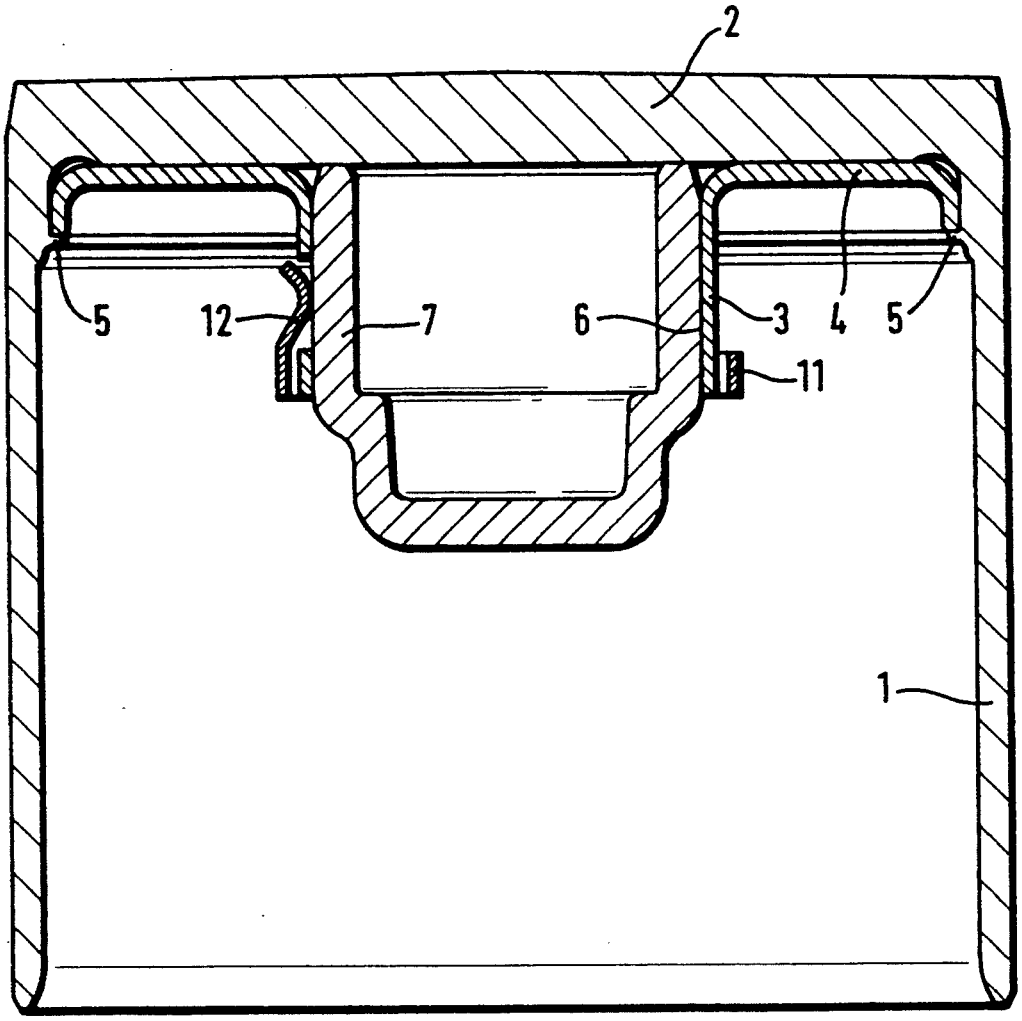
Figure 2A:
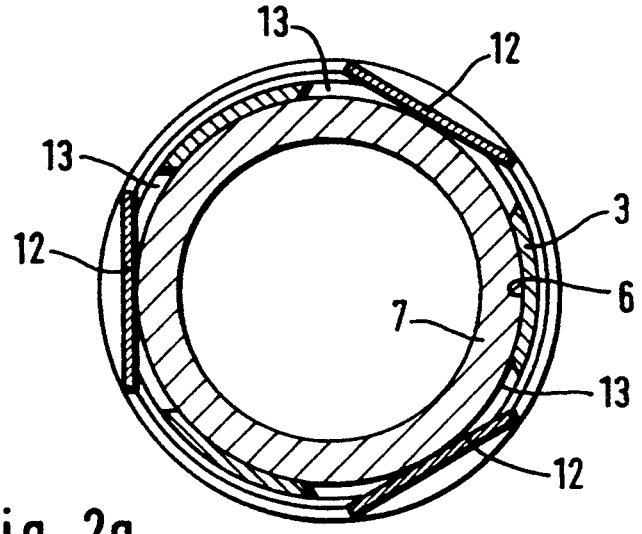

FIGS. 2 and 2*a* show a resiliently biased element in the form of a metallic ring 11 from which fingers 12 project in the axial direction. These FIGS. 12 are biased radially inwardly and extend through openings 13 in the hub 3.

Figure 3:
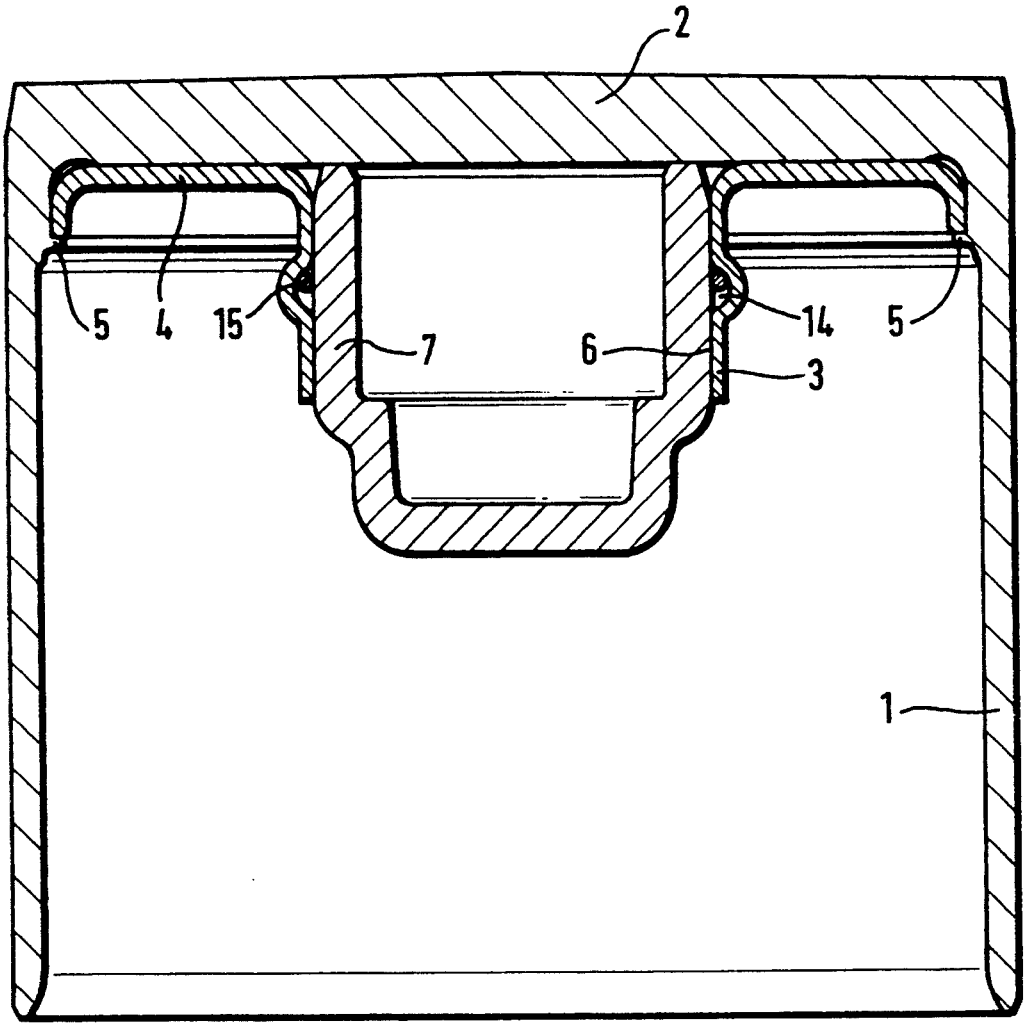
Figure 3A:
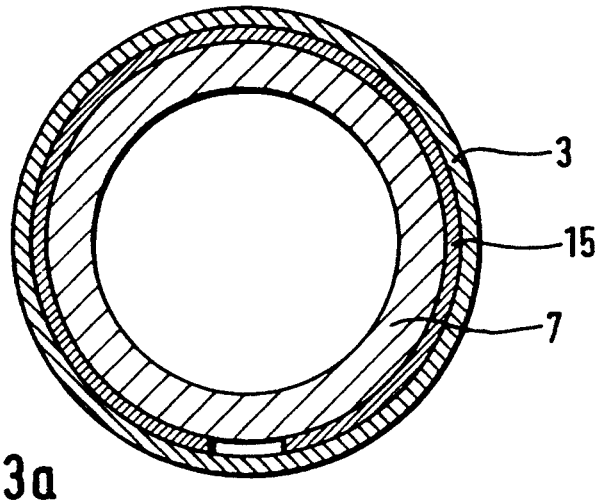

The hub 3 of FIGS. 3 and 3a is comprised of an annular groove 14 in which a simple metallic spring washer 15 is arranged which, because of its radial pre-tension, is urged both against the annular groove and against the peripheral surface of the adjusting element 7.

Figure 4:
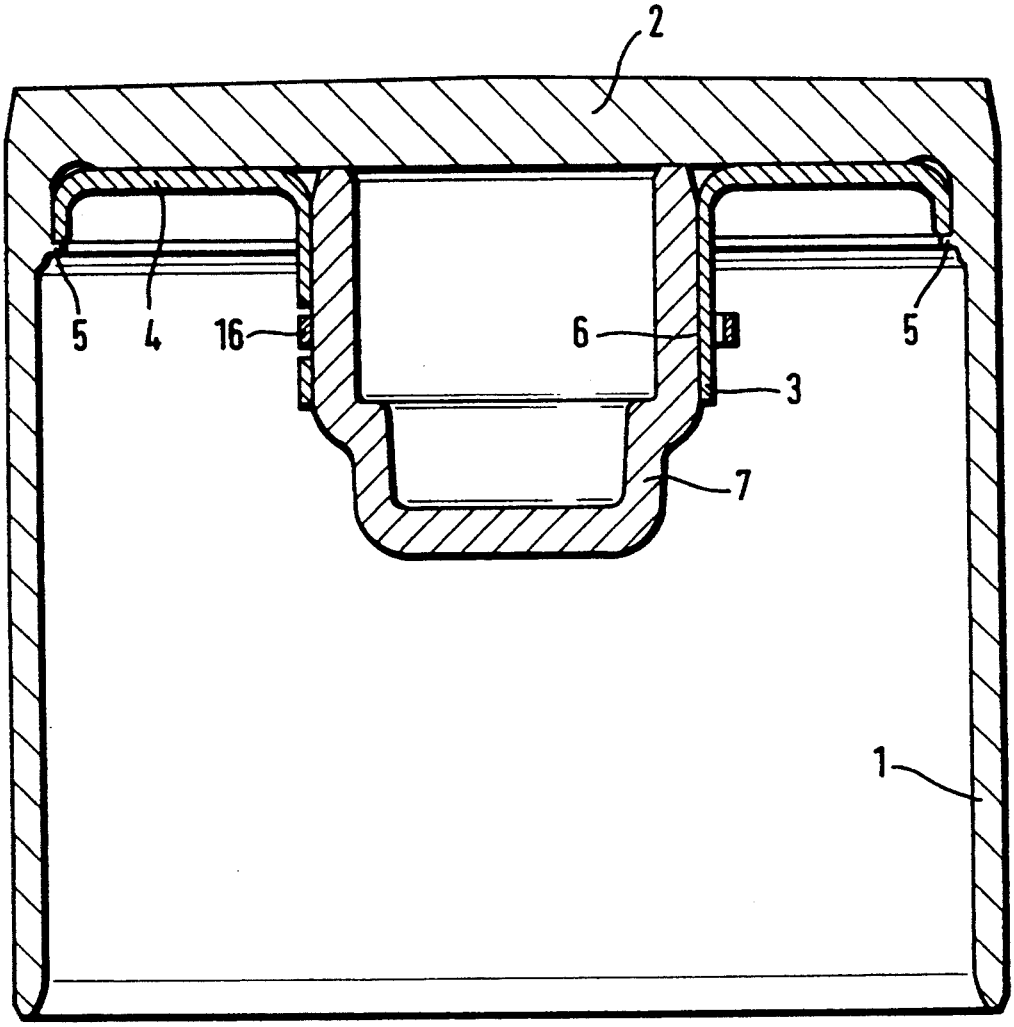
Figure 4A:
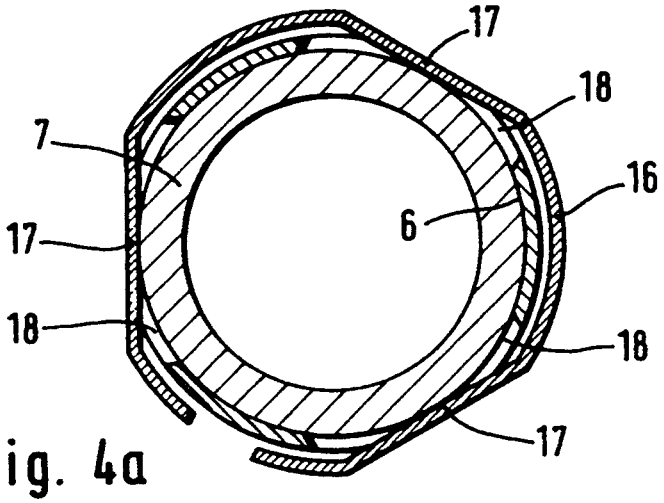
Figure 5:
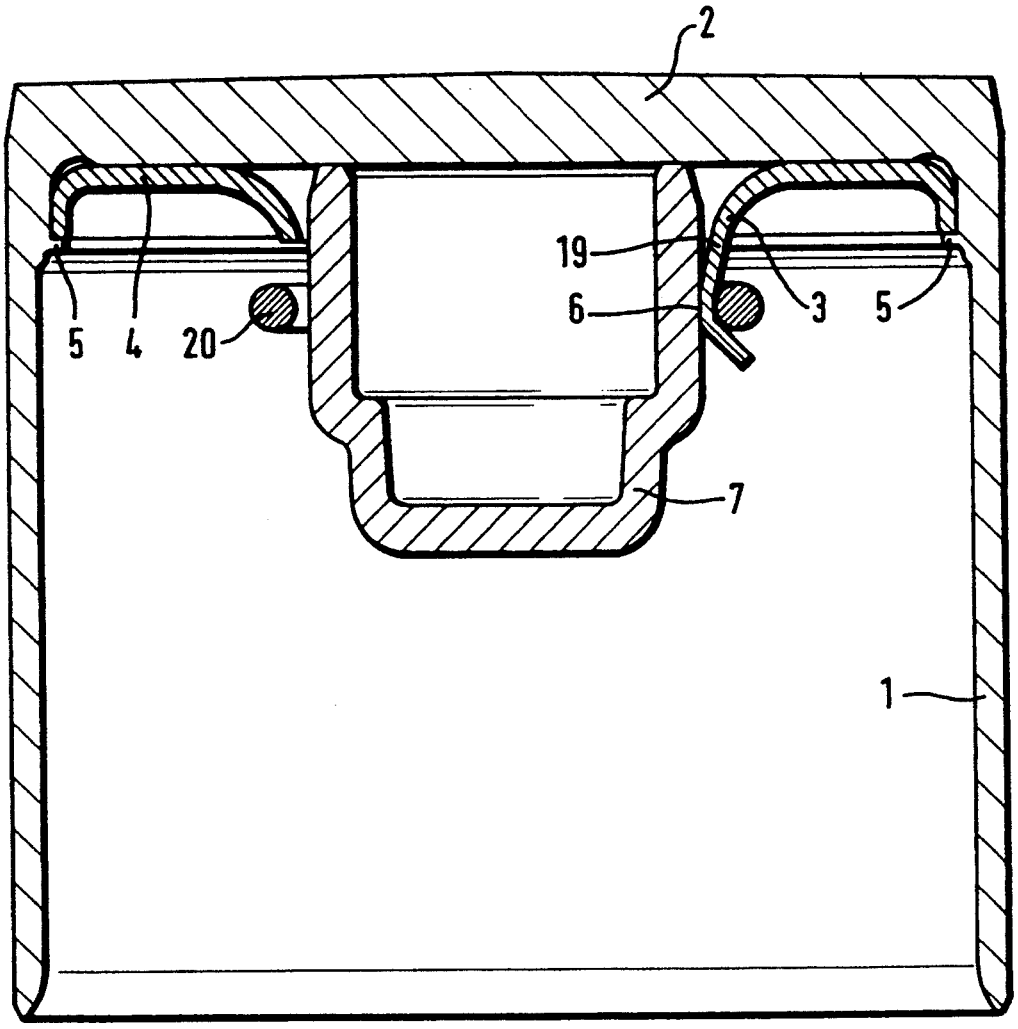
Figure 5A:
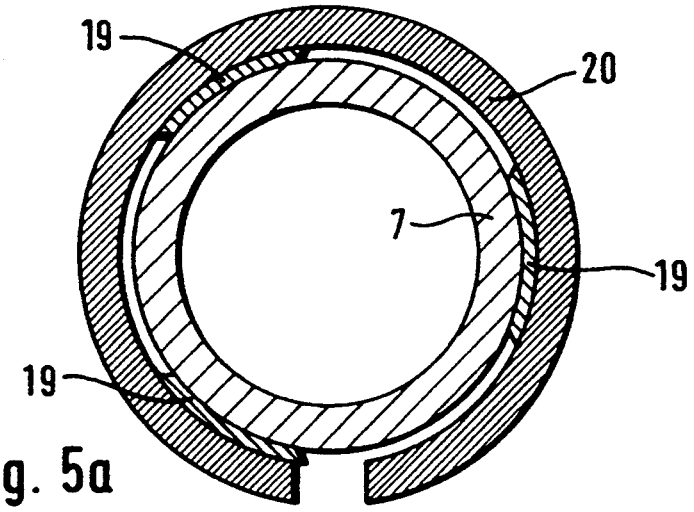

In the example of FIG. 4, a resiliently biased element is provided which is likewise configured as a metallic spring washer 16 with a polygonal shape whose chordlike portions 17 extend through slots 18 in the hub. According to FIG. 5, the hub 3 is made of deformable segments 19 which are circumferentially surrounded by a metallic annular spring 20.

Figure 6:
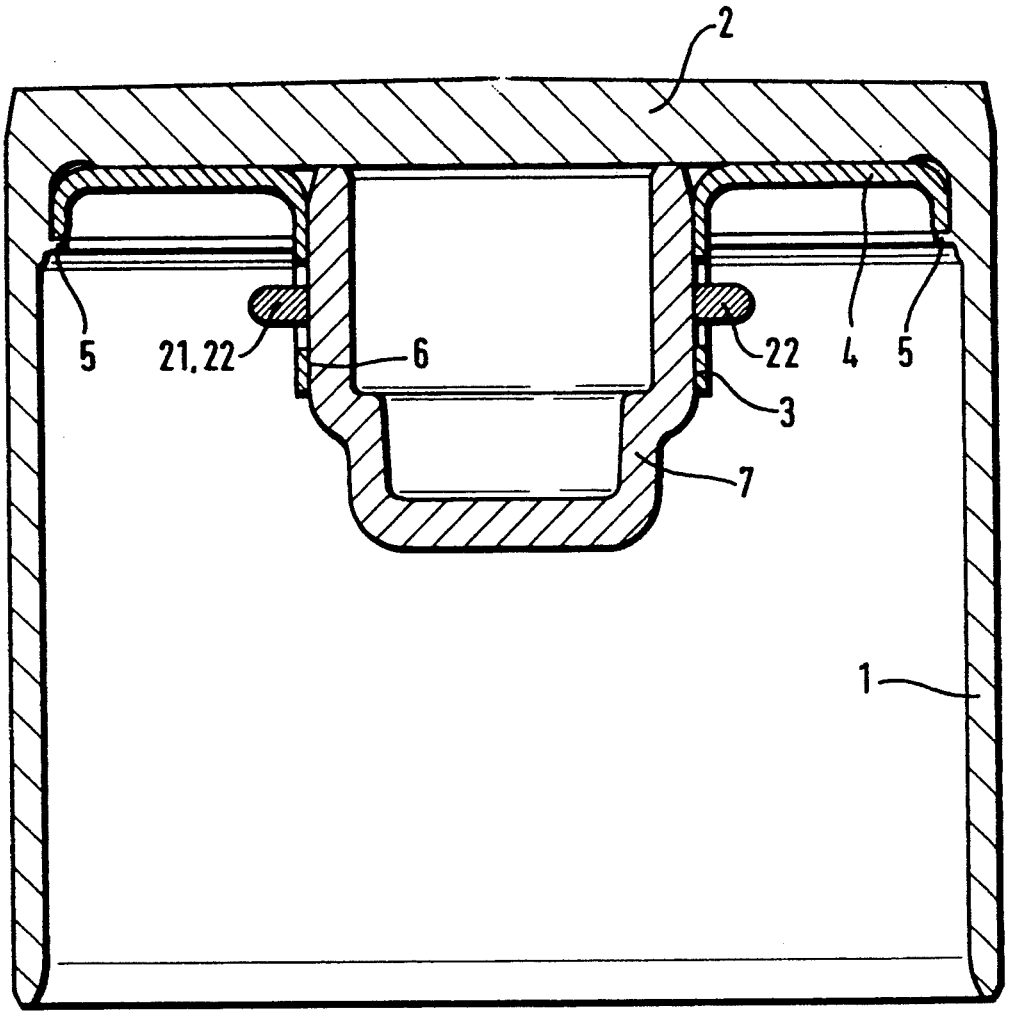
Figure 6A:
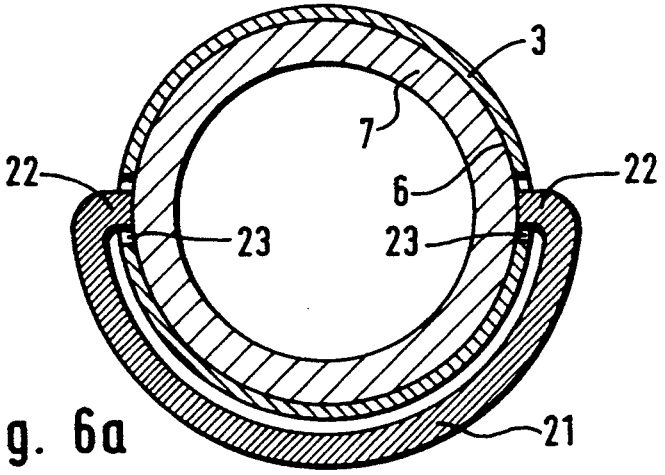

Another embodiment of the resiliently biased element is shown in FIGS. 6 and 6*a*. This resilient element 21 is shackle-shaped and comprises radially inwardly angled ends 22 which extend resiliently through openings 23 and thus bear against the outer peripheral surface of the adjusting element 7.

Figure 7:
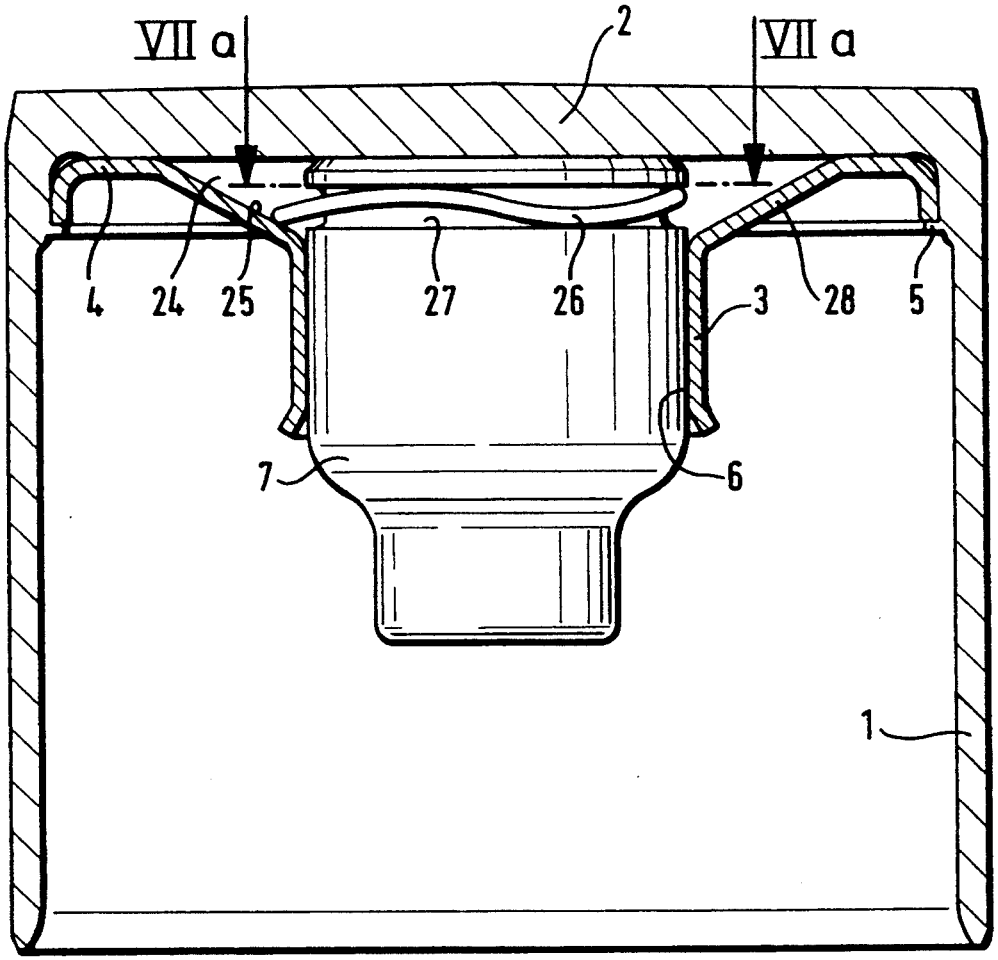
Figure 7A:
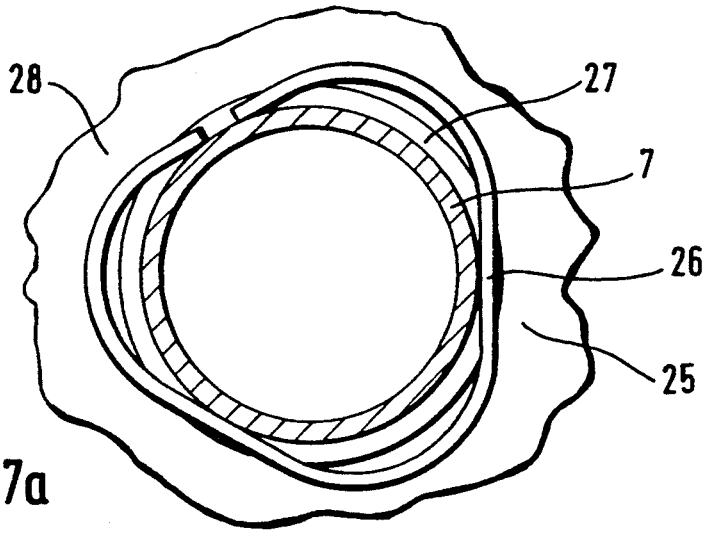

Finally, according to FIGS. 7 and 7*a*, the hub 3 is configured so that a free space 24 comprising a contact surface 25 is formed. A resilient element 26 in the form of a crinkled spring bears against this contact surface 25 and is arranged at the same time in an annular groove 27 of the adjusting element 7. As a result, the adjusting element 7 is snapped into the free space 24 and biased towards the bottom 2 so that no play can occur between the adjusting element 7 and the bottom 2. To form the free space 24 in this embodiment, an end of the hub facing the bottom 2 comprises a truncated portion 28 which merges into the disc-shaped element 4. The resilient element 26 is supported on the truncated portion 28 so that a pre-tensioning force acts on the wavy resilient element 26, both in the radial and in the axial direction, thus preventing a vibration thereof which would result in noise generation.

Various modifications of the valve tappet of the invention nay be made without departing from the spirit or scope thereof and it is to be understood that the invention is intended to be limited only as defined in the appended claims.

What is claimed is:

1. A mechanical valve tappet arranged in a guide bore of a cylinder head of an internal combustion engine comprising a cup-shaped housing with a hollow cylindrical wall (1) closed at one end by a bottom (2) which is contacted exteriorly by a control cam while a first flat end face of an adjusting element (7) bears against an inner surface of the bottom (2), a second flat end face of the adjusting element (7) which is parallel to the said first flat end face is in contact with an end of a valve stem of an engine valve, and the adjusting element (7) has a cylindrical peripheral surface and is retained by force engagement in a bore (6) of a hub (3) fixed to the said inner surface of the bottom (2), characterized in that an element (9, 11, 15, 16, 20, 21, 22, 26) which is resiliently biased with respect to the adjusting element (7) and the hub (3) is arranged between the hub (3) and the adjusting element (7).

2. A mechanical valve tappet of claim 1 wherein the resilient element is made of an elastomeric material and is arranged in a radial annular groove of at least one of the adjusting element (7) and the hub (3).

3. A mechanical valve tappet of claim 1 wherein the resilient element is made in the form of a metallic spring washer (9) and is arranged in a radial annular groove (8) of at least one of the hub (3) and the adjusting element (7).

4. A mechanical valve tappet of claim 1 wherein the resilient element is made as a metallic spring washer (16) comprising chordlike portions (17) which engage through slots (18) in the hub (3).

5. A mechanical valve tappet of claim 1 wherein the resilient element is made as a ring (11) comprising resilient fingers (12) projecting in the axial direction which are biased radially inwards and engage through openings (13) in the hub (3).

6. A mechanical valve tappet arranged in a guide bore of a cylinder head of an internal combustion engine comprising a cup-shaped housing with a hollow cylindrical wall (1) closed at one end by a bottom (2) which is contacted exteriorly by a control cam while a first flat end face of an adjusting element (7) bears against an inner surface of the bottom (2), a second flat end face of the adjusting element (7) which is parallel to the said first flat end face is in contact with an end of a valve stem of an engine valve, and the adjusting element (7) has a cylindrical peripheral surface and is retained by force engagement in a bore (6) of a hub (3) fixed to said inner surface of the bottom (2), characterized in that a resilient element (20) surrounds the hub (3) and biases the hub (3) towards the outer peripheral surface of the adjusting element (7).

7. A mechanical valve tappet arranged in a guide bore of a cylinder head of an internal combustion engine comprising a cup-shaped housing with a hollow cylindrical wall (1) closed at one end by a bottom (2) which is contacted exteriorly by a control cam while a first flat end face of an adjusting element (7) bears against an inner surface of the bottom (2), a second flat end face of the adjusting element (7) which is parallel to the said first flat end face is in contact with an end of a valve stem of an engine valve, and the adjusting element (7) has a cylindrical peripheral surface and is retained by force engagement in a bore (6) of a hub (3) fixed to said inner surface of the bottom characterized in that a resilient element (21) surrounds a part of the periphery of the hub (3), and radially inwards angled ends of the resilient element (21) engage in the manner of a shackle through openings (23) in the hub (3) and bear against the peripheral surface of the adjusting element (7).

8. A mechanical valve tappet arranged in a guide bore of a cylinder head of an internal combustion engine comprising a cup-shaped housing with a hollow cylindrical wall (1) closed at one end by a bottom (2) which is contacted exteriorly by a control cam while a first flat end face of an adjusting element (7) bears against an inner surface of the bottom (2), a second flat end face of the adjusting element (7) which is parallel to the said first flat end face is in contact with an end of a valve stem of an engine valve, and the adjusting element (7) has a cylindrical peripheral surface and is retained by force engagement in a bore (6) of a hub (3) fixed to said inner surface of the Bottom characterized in that the bore (6) merges into a free space (24 in which a resilient element (26) is biased radially and axially towards the bottom (2) at at least one contact surface (251, while an inner periphery of the resilient element (26) bears against an annular groove (27) of the adjusting element (7).

9. A mechanical valve tappet of claim 8 wherein an end of the hub (3) facing the bottom (2) merges into a truncated portion (28) which continues into a disc-shaped element (4) extending parallel to the bottom (2), while the resilient element (26) bears against the truncated portion (28).

* * * * *